US009560885B2

(12) United States Patent
Turlan

(10) Patent No.: US 9,560,885 B2
(45) Date of Patent: Feb. 7, 2017

(54) BRA CUP HAVING AN ENHANCING EFFECT

(71) Applicant: Hanes Operations Europe SAS, Rueil-Malmaison (FR)

(72) Inventor: Manon Turlan, Marmagne (FR)

(73) Assignee: Hanes Operations Europe SAS, Rueil Malmaison (FR)

( * ) Notice: Subject to any disclaimer, the term of this patent is extended or adjusted under 35 U.S.C. 154(b) by 35 days.

(21) Appl. No.: 14/442,360

(22) PCT Filed: Nov. 12, 2013

(86) PCT No.: PCT/FR2013/052709
§ 371 (c)(1),
(2) Date: May 12, 2015

(87) PCT Pub. No.: WO2014/072666
PCT Pub. Date: May 15, 2014

(65) Prior Publication Data

US 2016/0255881 A1 Sep. 8, 2016

(30) Foreign Application Priority Data

Nov. 12, 2012 (FR) ..... 12 60728

(51) Int. Cl.
*A41C 3/10* (2006.01)

(52) U.S. Cl.
CPC ..... *A41C 3/10* (2013.01)

(58) Field of Classification Search
CPC ..... A41C 3/10; A41C 3/0028; A41C 3/0014; A41C 3/12; A41C 3/144; A41C 3/42; A41C 5/005
USPC ..... 450/39, 54–57
See application file for complete search history.

(56) References Cited

U.S. PATENT DOCUMENTS

| | | | | |
|---|---|---|---|---|
| 2,516,129 A | | 7/1950 | Leo et al. | |
| 2,826,202 A | | 3/1958 | Sidney | |
| 4,372,321 A | * | 2/1983 | Robinson | A41C 3/142 450/39 |
| 4,531,525 A | | 7/1985 | Richards | |

(Continued)

FOREIGN PATENT DOCUMENTS

| | | |
|---|---|---|
| CN | 2778003 Y | 5/2006 |
| CN | 2847885 Y | 12/2006 |

(Continued)

OTHER PUBLICATIONS

International Search Report issued Mar. 28, 2014 re: Application No. PCT/FR2013/052709; citing: US 6 142 852 A, FR 2 972 905 A1, GB 484 367 A and WO 2006/025754 A1.

(Continued)

*Primary Examiner* — Gloria Hale
(74) *Attorney, Agent, or Firm* — Fish & Richardson P.C.

(57) ABSTRACT

The invention concerns a cup (12) for a bra (10) that comprises an outer shell (38) forming a recess (40) of a generally hemispherical shape and that is defined by a peripheral edge (32), characterized in that the cup (12) comprises at least an inner skin (42) forming a lining that is fixed to the peripheral edge (32) of the cup (12) and that partially covers the recess (40) formed by the outer shell (38), defining a space with the outer shell (38), and in that the inner skin (42) is designed to be tensioned when the cup (12) is placed on a breast.

9 Claims, 1 Drawing Sheet

(56) References Cited

U.S. PATENT DOCUMENTS

| | | | | |
|---|---|---|---|---|
| 6,101,630 | A | 8/2000 | Lee | |
| 6,142,852 | A | 11/2000 | Lerolle-Lelorrain | |
| 7,163,432 | B2 | 1/2007 | Mitchell et al. | |
| 7,887,389 | B1 * | 2/2011 | Lacambra | A41C 3/144 450/39 |
| 8,047,891 | B1 | 11/2011 | Albritton | |
| 2003/0094333 | A1 * | 5/2003 | Hossler | A63J 1/028 188/65.1 |
| 2004/0147203 | A1 * | 7/2004 | Luk | A41C 3/12 450/39 |
| 2005/0020083 | A1 * | 1/2005 | Numanami | G03F 1/60 438/691 |
| 2006/0025041 | A1 * | 2/2006 | Falla | A41C 3/10 450/39 |
| 2006/0052034 | A1 * | 3/2006 | Falla | A41C 3/0014 450/39 |
| 2007/0026767 | A1 * | 2/2007 | Scheininger | A41C 3/0028 450/39 |
| 2009/0181599 | A1 * | 7/2009 | Farmer | A41C 3/10 450/39 |
| 2010/0015886 | A1 * | 1/2010 | Waitz | A41C 3/10 450/39 |
| 2010/0267312 | A1 | 10/2010 | Chien | |

FOREIGN PATENT DOCUMENTS

| | | | |
|---|---|---|---|
| CN | 201174976 | Y | 1/2009 |
| DE | 202012003154 | U1 | 7/2012 |
| FR | 2972905 | A1 | 9/2012 |
| GB | 484367 | A | 5/1938 |
| GB | 2386382 | A | 9/2003 |
| WO | 2006025754 | A1 | 3/2006 |

OTHER PUBLICATIONS

International Search Report issued Mar. 28, 2014 re: Application No. PCT/FR2013/052723; citing: US 2 826 202 A, US 2010/267312 A1, US 8 047 891 B1, US 2 516 129 A, US 6 101 630 A and DE 20 2012 003154 U1.

International Search Report issued Feb. 3, 2014 re: Application No. PCT/FR2013/052722; citing: GB 2 386 382 A and US 7 163 432 B2.

The State Intellectual Property Office of the People's Republic of China, Chinese Application No. 2013800566643, Mar. 1, 2016, 6 pages.

* cited by examiner

BRA CUP HAVING AN ENHANCING EFFECT

CROSS-REFERENCE TO RELATED APPLICATIONS

This application is a U.S. National Phase Application under 35 U.S.C. §371 and claims the benefit of priority to International Application Serial No. PCT/FR2013/052709, filed on Nov. 12, 2013, which claims priority to French Application Serial No. FR12/60728, filed on Nov. 12, 2012, the contents of which are hereby incorporated by reference.

TECHNICAL FIELD

The invention relates to a lightweight bra cup for giving the bust an enhancing effect called "push-up" effect.

BACKGROUND

It is known many cups which are designed for making a bra with a "push-up" effect, which allows visually increasing the size of the bust by one size or more.

Document FR-A-2972905 describes and represents a bra cup structure which includes an external layer and an internal layer stuck together enclosing therebetween a pocket containing a malleable material, in silicone gel according to this document.

The pocket is constituted of two fine polymeric films which are sealed together in a permeable manner in order to imprison the silicone gel.

Although this type of cup fulfills its role of giving the bust an enhancing effect, the presence of the filling material of the pocket has in particular, the drawback of adding an additional weight to the bra which may cause discomfort.

BRIEF SUMMARY

The purpose of the invention is in particular to overcome this issue by proposing a lightened cup allowing a "push-up" effect.

In addition, the purpose of the invention is to propose a cup with a simplified design which does not require an added pocket for retaining a filling material.

To this end, the invention proposes a bra cup which includes an external shell forming a recess of globally hemispherical shape and which is delimited by a peripheral edge, characterized in that the cup includes at least one internal skin forming a lining which is fixed on the peripheral edge of the cup and which partially covers the recess formed by the external shell, by delimiting a space with the external shell, and in that the internal skin is suitable for being tensioned when the cup is placed on a bust.

Such a design allows the internal skin to push the bust towards the décolletage in order to cause an enhancing effect, without adding a cushion.

According to another feature, the internal skin substantially covers a lateral half of the cup.

This feature allows guiding the bust towards the décolletage part of the cup.

In addition, the internal skin includes a lateral edge which extends through the cup from an upper section of the peripheral edge of the cup, to a lower section of the peripheral edge of the cup, the internal skin being arranged in such a manner as to push the bust towards a décolletage part of the cup.

Furthermore, the internal skin is fixed on the peripheral edge of the cup by means of seams.

According to another aspect, the internal skin is made in expansible fabric of tulle type.

This type of material is breathable, comfortable and expansible.

In addition, the internal skin is capable of being elastically expanded according to a range between fifty percent and one hundred and fifty percent with respect to an initial rest state.

According to another aspect, the external shell is made in thermoformed polyurethane foam.

In addition, the external shell has a thickness ranging between 8 and 15 millimeters before thermoforming.

Finally, the external shell has a thickness ranging between 3 and 6 millimeters after thermoforming.

The invention also relates to a bra including the aforementioned pair of cups.

BRIEF DESCRIPTION OF THE DRAWINGS

Other features and advantages of the invention will become apparent upon reading the following detailed description for the comprehension of which reference will be made to the accompanying drawings in which.

DETAILED DESCRIPTION

Figure 1:
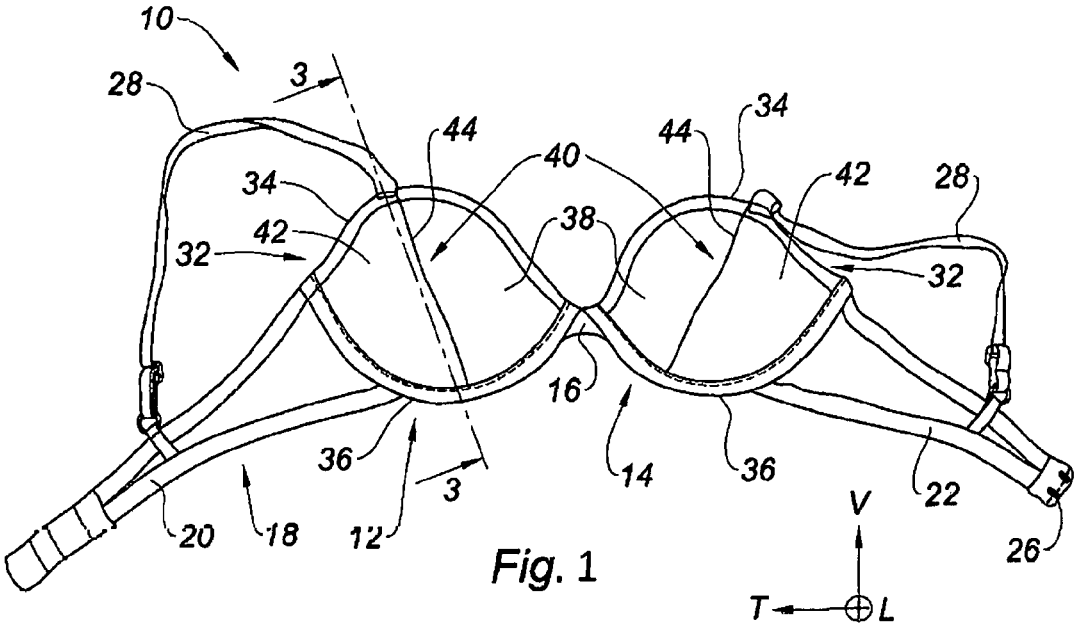
FIG. 1 is a perspective overall view, which illustrates a bra including a first left cup and a second right cup according to the invention.

In the description and claims, the expressions "upper" and "lower" will be used in a non limiting manner in reference to the upper part and the lower part respectively of FIG. 1.

Figure 2:
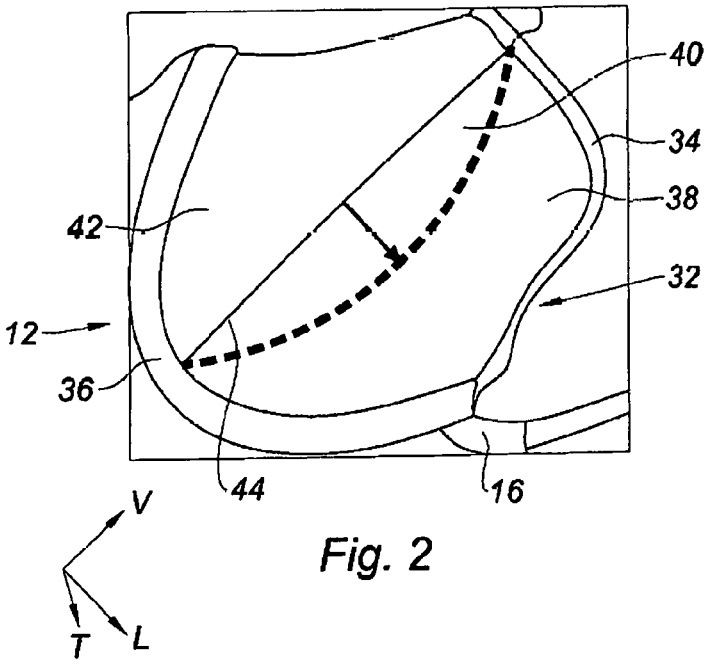
FIG. 2 is a perspective detailed view, which illustrates the space delimited between the external shell and the internal skin of the first left cup of FIG. 1.

In addition, in order to clarify the description and claims, the longitudinal, vertical and transversal terminology will be used in a non limiting manner in reference to the trihedral L, V, T indicated on FIGS. 1 and 2.

It has been represented on FIG. 1 a bra 10 which includes a first left cup 12 and a second right cup 14 which are transversally aligned and which are connected by a central supporting component 16.

In addition, the bra 10 is equipped with a dorsal fixing strip 18 which is formed by a first part 20 connected on the first cup 12 and by a second part 22 connected on the second cup 14.

The fixing strip 18 is provided with a fastening means, which includes a staple 26 mounted on the first part 20 of the fixing strip 18 and a series of additional notches (not represented) mounted on the second part 22 of the fixing strip 18.

In a complementary manner, the bra 10 includes a pair of straps 28 allowing the bra 10 to be worn on the shoulders of the person wearing it.

Each cup 12, 14 is delimited by a peripheral edge 32 which includes an upper section 34 forming décolletage and a lower section 36 housing an added framework, such as a metallic framework.

In addition, each cup 12, 14 includes an external shell 38 forming a recess 40 of globally hemispherical shape, cambered towards the front along a longitudinal direction, as it can be seen schematically illustrated by the dots and arrow of FIG. 2.

The first left cup 12 and the second right cup 14 being similar and arranged symmetrically in order to form the bra 10, only the first left cup 12, called "cup" in the rest of the description, will be described in detail.

The cup 12 includes an internal skin 42 forming a lining which is fixed on the peripheral edge 32 delimiting the cup 12, by means of seams for example.

Figure 3:
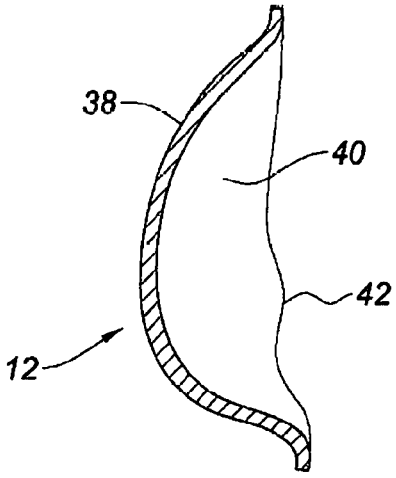
FIG. 3 is a sectional view according to line 3-3 of FIG. 1, which illustrates the profile of the first left cup of FIG. 1.

In reference to FIGS. 2 and 3, the internal skin 42 partially covers the recess 40 formed by the external shell 38, by delimiting an empty space with the external shell 38 which is illustrated by the arrow of FIG. 2.

The internal skin 42 substantially covers a lateral half of the cup 12, facing the décolletage part of the cup 12, in such a manner that the internal skin 42 pushes the bust towards the décolletage, that is to say towards the central part and towards the top of the bra 10.

More particularly, the internal skin 34 includes a lateral edge 44 which expands across the cup 12 from the upper section 34, to the lower section 36 of the peripheral edge 32 of the cup 12.

The internal skin 34, in a rest position in which the cup 12 is not worn, is more or less tensed according to the required enhancing effect.

On the other hand, the internal skin 34, in an active position in which the cup is worn by a person, is tensioned in such a manner as to push the bust towards a décolletage part of the cup 12.

To this end, the internal skin 34 is capable of being elastically expanded according to a range between fifty percent and one hundred and fifty percent with respect to an initial state of rest, for example.

According to another aspect, the internal skin 34 is made in an expansible fabric of tulle type, for example in fabric known by the name of "powernet" which designates a nervous fabric made from elastane fibers and nylon fibers.

In addition, the external shell 38 is made in thermoformed polyurethane foam.

The external shell 38 is designed so as to hardly or not become deformed when the cup 12 is worn by a person.

To this end, as a reference, the external shell 38 has a thickness ranging between 8 and 15 millimeters before thermoforming, and a thickness ranging between 3 and 6 millimeters after thermoforming.

According to a non represented variant, the cup 12 includes a plurality of internal skins which cover each other, in totality or partially, in such a manner as to play on the expansibility and elastic resistance of the assembly constituted by the internal skins.

The invention claimed is:

1. A bra cup, comprising:

an external shell forming a recess of globally hemispherical shape and which is delimited by a peripheral edge, at least one internal skin forming a lining which is fixed on the peripheral edge of the cup and which partially covers the recess formed by the external shell by delimiting a space with the external shell, wherein the internal skin includes a lateral edge which extends across the cup from an upper section of the peripheral edge of the cup to a lower section of the peripheral edge of the cup, and wherein the internal skin is tensioned when the cup is placed on a bust of a wearer, the internal skin configured to push the bust toward a décolletage part of the cup.

2. The bra cup according to claim 1, wherein the internal skin substantially covers a lateral half of the cup.

3. The bra cup according to claim 1, wherein the internal skin is fixed on the peripheral edge of the cup by means of seams.

4. The bra cup according to claim 1, wherein the internal skin comprises an expansible tulle fabric.

5. The bra cup according to claim 1, wherein the internal skin is capable of being elastically expanded according to a range between fifty percent and one hundred and fifty percent with respect to an initial rest state.

6. The bra cup according to claim 1, wherein the external shell is made in thermoformed polyurethane foam.

7. The bra cup according to claim 6, wherein the external shell has a thickness ranging between 8 and 15 millimeters before thermoforming.

8. The bra cup according to claim 6, wherein the external shell has a thickness ranging between 3 and 6 millimeters after thermoforming.

9. A bra including a pair of cups according to claim 1.

* * * * *